US010130124B2

(12) United States Patent
Wong et al.

(10) Patent No.: US 10,130,124 B2
(45) Date of Patent: Nov. 20, 2018

(54) LOW TEMPERATURE HEAT NOT BURN ELECTRONIC CIGARETTE

(71) Applicant: Shanghai Green Vaper Technology Co., Ltd., Shanghai (CN)

(72) Inventors: Tan Wong, Shanghai (CN); Yanmin Nie, Shanghai (CN)

(73) Assignee: Shanghai Green Vaper Technology Co., Ltd., Shanghai (CN)

( * ) Notice: Subject to any disclaimer, the term of this patent is extended or adjusted under 35 U.S.C. 154(b) by 0 days.

(21) Appl. No.: 15/498,878

(22) Filed: Apr. 27, 2017

(65) Prior Publication Data

US 2018/0153216 A1 Jun. 7, 2018

(30) Foreign Application Priority Data

Dec. 6, 2016 (CN) ..... 2016 1 1108583
Dec. 6, 2016 (CN) ..... 2016 2 1327815 U

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 47/00*** | (2006.01) |
| ***H05B 3/42*** | (2006.01) |

(52) U.S. Cl.
CPC ..... *A24F 47/008* (2013.01); *A24F 47/002* (2013.01); *H05B 3/42* (2013.01)

(58) Field of Classification Search
CPC ..... A24F 47/008; H05B 3/42; H05B 1/0291; A61M 11/092
USPC ..... 131/329, 328
See application file for complete search history.

(56) References Cited

U.S. PATENT DOCUMENTS

2004/0016436 A1* 1/2004 Thomas ..... A24D 3/022 131/202
2014/0150785 A1* 6/2014 Malik ..... A61M 15/06 128/202.21
2014/0338686 A1* 11/2014 Plojoux ..... A24F 47/008 131/329
2015/0040922 A1* 2/2015 Dube ..... A24B 15/18 131/275
2015/0209530 A1* 7/2015 White ..... A61M 11/042 424/729
2016/0250201 A1* 9/2016 Rose ..... A61K 31/4439 131/329
2016/0255879 A1* 9/2016 Paprocki ..... H05B 1/0291
2016/0374397 A1* 12/2016 Jordan ..... A24F 47/008 131/329

(Continued)

*Primary Examiner* — Hae Moon Hyeon
(74) *Attorney, Agent, or Firm* — Clement Cheng

(57) ABSTRACT

The present invention relates to a low-temperature heat-not-burn electronic cigarette comprised of the first holder including a pipe and a mounting plate with the mounting plate connected to the external wall of the pipe. The mounting plate and the second holder are connected to form an inner cavity with a control plate fixed in the inner cavity and the second holder having a key linked to the buttons on the control plate with the buffer pads. The pipe has a corrugated internal wall and a movable cigarette cartridge. The pipe is inserted into an outer pipe. The outer pipe has an insulation retaining bracket and a battery with the insulation retaining bracket having an installation slot facing the cigarette cartridge and the heating coil on the installation slot.

12 Claims, 6 Drawing Sheets

(56) References Cited

U.S. PATENT DOCUMENTS

2017/0319799 A1* 11/2017 Yamada ..... A61M 15/06

* cited by examiner

LOW TEMPERATURE HEAT NOT BURN ELECTRONIC CIGARETTE

CROSS-REFERENCE TO RELATED APPLICATIONS

This application claims foreign priority from China application number 201621327815.1 filed by applicant Shanghai Green Vapor Electronic Technology Co., Ltd. c/o Yanmin Nie on Dec. 6, 2016 entitled Low-Temperature Heat-Not-Burn Electric Smoking Tool, the disclosure of which is incorporated herein by reference. This application also claims foreign priority from China application number 201611108583.5 filed by applicant Shanghai Green Vapor Electronic Technology Co., Ltd. c/o Yanmin Nie on Dec. 6, 2016 entitled Low-Temperature Heat-To-Burn Cigarette And Its Preparation Method.

FIELD OF TECHNOLOGY

The present invention, relates to a low temperature non-combustion heated electronic cigarette.

DISCUSSION OF RELATED ART

Low-temperature non-combustion heated technology for electronic cigarettes relies on heated plant material releasing effective content during the carbonization phase before ignition. Non-combustion reduces the tar and harmful substance produced by the burning tobacco to the greatest extent. There are two kinds of technologies for existing low-temperature non-combustion heated also known as heat-not-burn electronic cigarettes, namely external and internal heating technologies. A tub shaped heating element is adopted by the external heating technology and most thermal energy is wasted, indicating a low effective heating rate of the cigarette cartridge whereas a pin-type or sheet-type heating element is adopted for internal heating technology which requires high level of coordination between the heating element and the cigarette cartridge, including a special design for repetitive insertion and special tools to clean residual carbon and adhesion in the cigarette cartridge.

In addition, when the enclosed slow heating and temperature control technique is applied to both of the above-mentioned technologies it results in complicated control systems, high-level waste of battery, less use of cigarette cartridge, and a passive demand for enlarging battery size.

Besides, because both of the above-mentioned technologies adopt ceramics and other electric heating base materials and these base materials are efficient in absorption of heat, it requires more time to heat the cigarette cartridge and users have to wait for a long time before use. These technologies also have other problems such as small amount of smoke, substantial smoking resistance and burning hot case that requires additional insulation materials and layers.

Low-temperature heat-not-burn cigarettes can reduce tar and harmful components so is becoming more popular. Existing low-temperature heat-not-burn cigarettes can be divided into fine-cut and sheet cigarettes. Fine-cut cigarettes are filled with cut tobacco based on regular cigarette making technology: putting tobacco leaves into a puffing process, shredding the natural tobacco leaves with a shredder, spraying flavors and fragrances and rolling the materials up with a cigarette making machine. A sheet cigarette is filled with thin slices based on complex technologies: crushing tobacco leaves, mixing water and cellulose to prepare stuff, using the stuff for paper making based on the paper-making technology and rolling the paper with the cigarette making machine after puffing and cutting. Considering the limitations of fine-cut and sheet cigarette making techniques, it is difficult to realize high density and air permeability at the same time. The core demand of a low-temperature heat-not-burn cigarette lies in the volatility of the effective contents in the cigarette which are not easy to ignite since the heating temperature is generally around 350° C. However, cigarettes of low density is easy to ignite whereas that of excessively high density usually has low porosity, resulting in inhalation resistance. Therefore, neither the fine-cut low-temperature heat-not-burn cigarette nor the sheet type provides a thorough solution to meeting the core demand for low-temperature heat-not-burn cigarette.

SUMMARY OF THE INVENTION

This invention mainly aims to introduce a low-temperature heat-not-burn electronic cigarette, providing an effective solution to the problems of using low-temperature heat-not-burn electronic cigarettes, such as pre-heating, substantial energy loss, small smoke volume, considerable smoking resistance, difficulties in cleaning, high density and air permeability and corresponding preparation methods.

To achieve the above-mentioned purpose, the invention offers a low-temperature heat-not-burn electronic cigarette comprised of the first holder, second holder, outer pipe, cigarette cartridge, control plate, keys, buffer pad, insulation retaining bracket, heating coil, battery, rivet and uprights. The first bolder has a pipe and a mounting plate and the mounting plate is attached to the external wall of the pipe, the mounting plate and the second holder forming an inner cavity. The control plate is fixed in the inner cavity. The second holder has a key that is linked to the buttons on the control plate with the buffer pad, a filtration rod, a honeycomb tobacco column and a heat-resistant paper with one end of the filtration rod attached to that of the tobacco column. The filtration rod and the tobacco column are wrapped by heat-resistant paper. Mixed powder is compressed into a tobacco column, and the mixed powder is comprised of: 70-90% tobacco or plant powder or both, 5-20% tobacco extract and 4-10% mixed powder of flavors and fragrances in terms of mass fraction.

The low-temperature heat-not-burn cigarette also contains tobacco extract made from one or more of tobacco concrete, essence, nicotine and solanesol; and the tobacco powder may contain one or more of flue-cured tobacco, burley tobacco, cigar or aromatic tobacco. The filtration rod can be a single, double or multiple-filter rod. The filtration rod can be made from acrylic fiber, cellulose acetate, crumpling paper or active carbon. The heat-resistant paper is made of Polypropylene Paper (PP), Polyethylene Terephthalate (PET), cellophane, ceramic fiber paper, teflon paper or aluminum foil. The mixed powder can contain 0.1-1% additives in terms of mass fraction. The additives contain one or more of tobacco glue, fire retardant and preservative.

A preparation method of the low-temperature heat-not-burn cigarette may have the following steps:

(1) Preparation of honeycomb tobacco column: Mix and grind the mixed powder and then compress it into a honeycomb tobacco column;

(2) Connect the compressed honeycomb tobacco column to one end of the filtration rod and wrap the tobacco column and filtration rod with the heat-resistant paper.

Optionally, the mixed powder is compressed with sheeter and honeycomb die after mixing and grinding.

The pipe has a corrugated internal wall with the movable cigarette cartridge inserted into the pipe. The pipe is connected to the outer pipe and therefore, the end of the pipe opposite to that connected to the outer pipe is being used as the insertion end of the cigarette cartridge. The pipe is connected to the internal surface of the outer pipe and the outer pipe has an insulation retaining bracket and battery in it with the insulation retaining bracket mounted between the cigarette cartridge and the battery. The insulation retaining bracket has an installation slot with the installation slot facing the cigarette cartridge and the heating coil installed in the installation slot. The heating coil has two pins with each of the pins respectively fixed on the upright with the rivet. The two uprights are mounted on the insulation retaining bracket. The two uprights are connected to the control plate at the bottom with welding electronic wires and the positive and negative electrodes of the battery are also connected to the control plate with electronic wires.

The pipe and the mounting plate are connected with a through hole so that the inner cavity and the internal of the pipe can be connected. The distance between the through hole and the connection between the pipe and the outer pipe is shorter than that between the through hole and the opposite end of connection between the mounting plate and the pipe. The mounting plate has a Universal Serial Bus (USB) that is exposed at the opposite end of the connection between the mounting plate and the pipe. The length of the corrugation is shorter than the length of the pipe with the corrugation is situated between the through hole and the insertion end of the cigarette cartridge. A protective ring is set between the cigarette cartridge and the pipe with the protective ring installed between the through hole and the opposite of the insertion end of the cigarette cartridge. A fixation ring is set between the protective ring and the pipe.

The opposite end of the connection between the outer pipe and the pipe has a lens. The outer pipe has a lamp panel and the lamp panel is mounted between the battery and the lens. The mounting plate has a clipping strip and the second holder has a slot matching with the clipping strip. The mounting plate is connected to the second holder with the clipping strip connected to the slot. The control plate has a hole for the clipping strip to pass through.

The heating coil is made of transfer heating element. The present invention can be optimized to have the following advantages:

(1) Air travels through the corrugated inner wall of the pipe and enters into the location where the heating coil is installed. Then, it is heated by the heating coil to form the hot air to be brought into the cigarette cartridge for efficient recycling of thermal energy, which has little smoke resistance, high carbonization rate and substantial amount of smoke and gets rid of the problem of a burning hot case without adding any insulation layers.

(2) The cigarette cartridge can be inserted into or removed from the pipe easily, offering a higher level of applicability. Moreover, the cigarette cartridge remains clean without adhesion or residual carbon after use and therefore, no extra cleaning tool will be required.

(3) The heating coil is made of transfer heating element such as a high thermal conductivity metal, which reduces the heating time of the cigarette cartridge and enables instant response. Users can control the operation of the heating coil by pressing the key, offering greater user experience.

(4) A tobacco column and a filtration rod are wrapped by a heat-resistant paper. In terms of mass fraction, because the tobacco column contains 70-90% tobacco or plant powder or both, 5-20% tobacco extract and 4-10% mixed powder of flavors and fragrances compressed into a honeycomb, the tobacco column of high density also shows a relatively high air permeability to meet the core demand of low-temperature heat-not-burn cigarette.

(5) With the preparation method the low-temperature heat-not-burn cigarettes can have high density and permeability at the same time. With the preparation method, it is also possible to produce low-temperature heat-not-burn cigarette of different density and permeability. Further explanation of the invention will be given with the following figures and embodiment.

The present invention relates to a low-temperature heat-not-burn electronic cigarette comprised of the first holder including a pipe and a mounting plate with the mounting plate connected to the external wall of the pipe. The mounting plate and the second holder are connected to form an inner cavity with a control plate fixed in the inner cavity and the second holder having a key linked to the buttons on the control plate with the buffer pads. The pipe has a corrugated internal wall and a movable cigarette cartridge. The pipe is inserted into an outer pipe. The outer pipe has an insulation retaining bracket and a battery in it with the insulation retaining bracket having an installation slot facing the cigarette cartridge and the heating coil on the installation slot. The heating coil have two pins with each pin respectively fixed on an upright with a rivet and these two uprights mounted on the insulation retaining bracket. When air travels through the pipe of corrugated internal wall and arrives at the location of heating coil, it will be heated by the heating coil and transferred into the cigarette cartridge, indicating efficient recycling of thermal energy.

The following call out list of elements can be a useful guide in referencing the element of the drawings.

1 Cigarette Cartridge
2 First Holder
3 Pipe
4 Mounting Plate
5 Key
6 Second Holder
7 Outer Pipe
8 Buffer Pad
9 Control Plate
10 Protective Ring

11 Fixation Ring
12 Installation Slot
13 Heating Coil
14 Rivet
15 Upright
16 Insulation Retaining Bracket
17 Battery
18 Lamp Panel
19 Lens
20 Through Hole
21 USB Connector
100 Low-Temperature Heat-Not-Burn Cigarette
110 Filtration Rod
120 Tobacco Column
121 Holes
130 Heat-Resistant Paper

DETAILED DESCRIPTION OF THE PREFERRED EMBODIMENT

Figure 1:
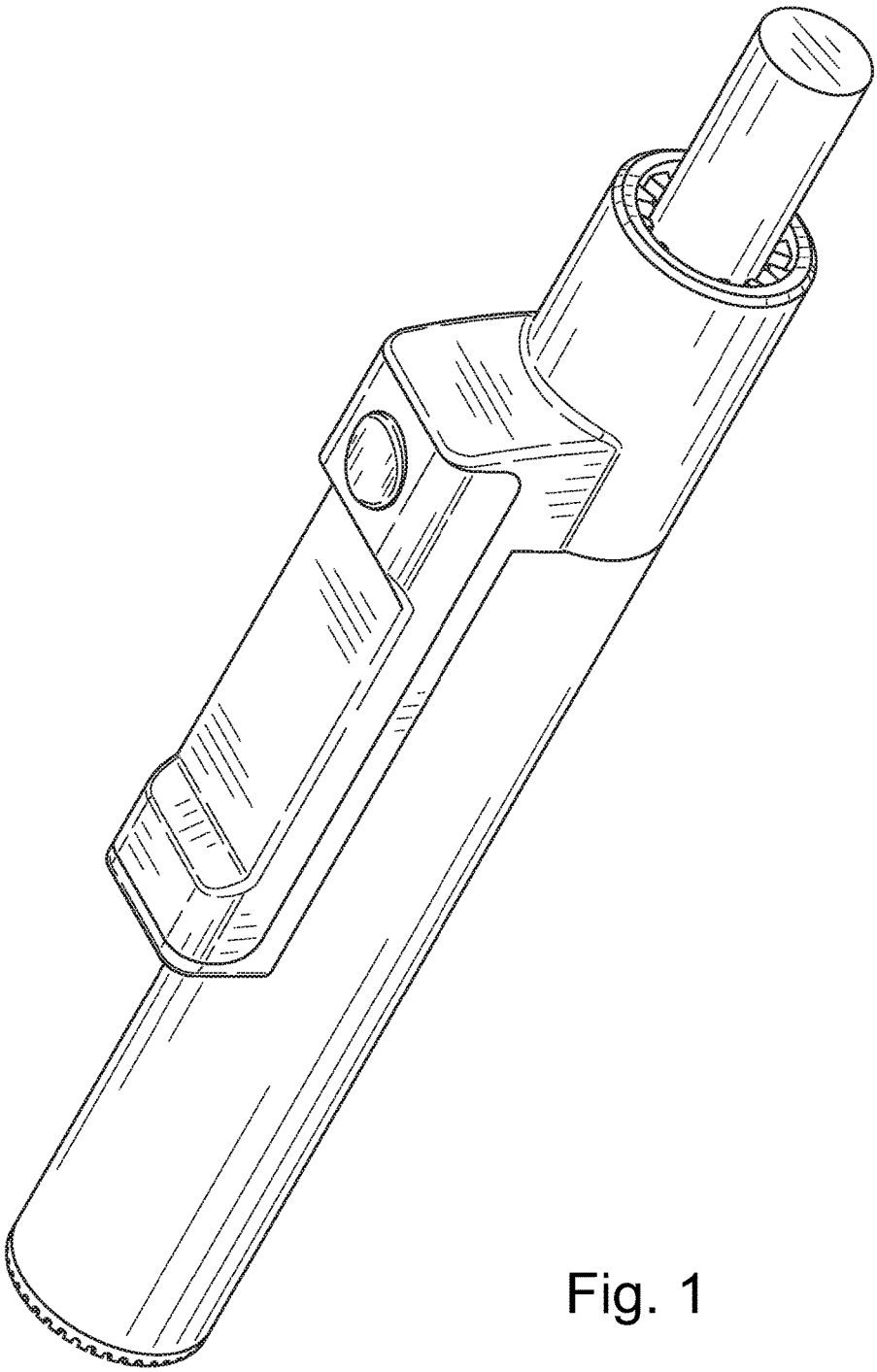
FIG. 1 is a perspective external view of the present invention.
Figure 2:
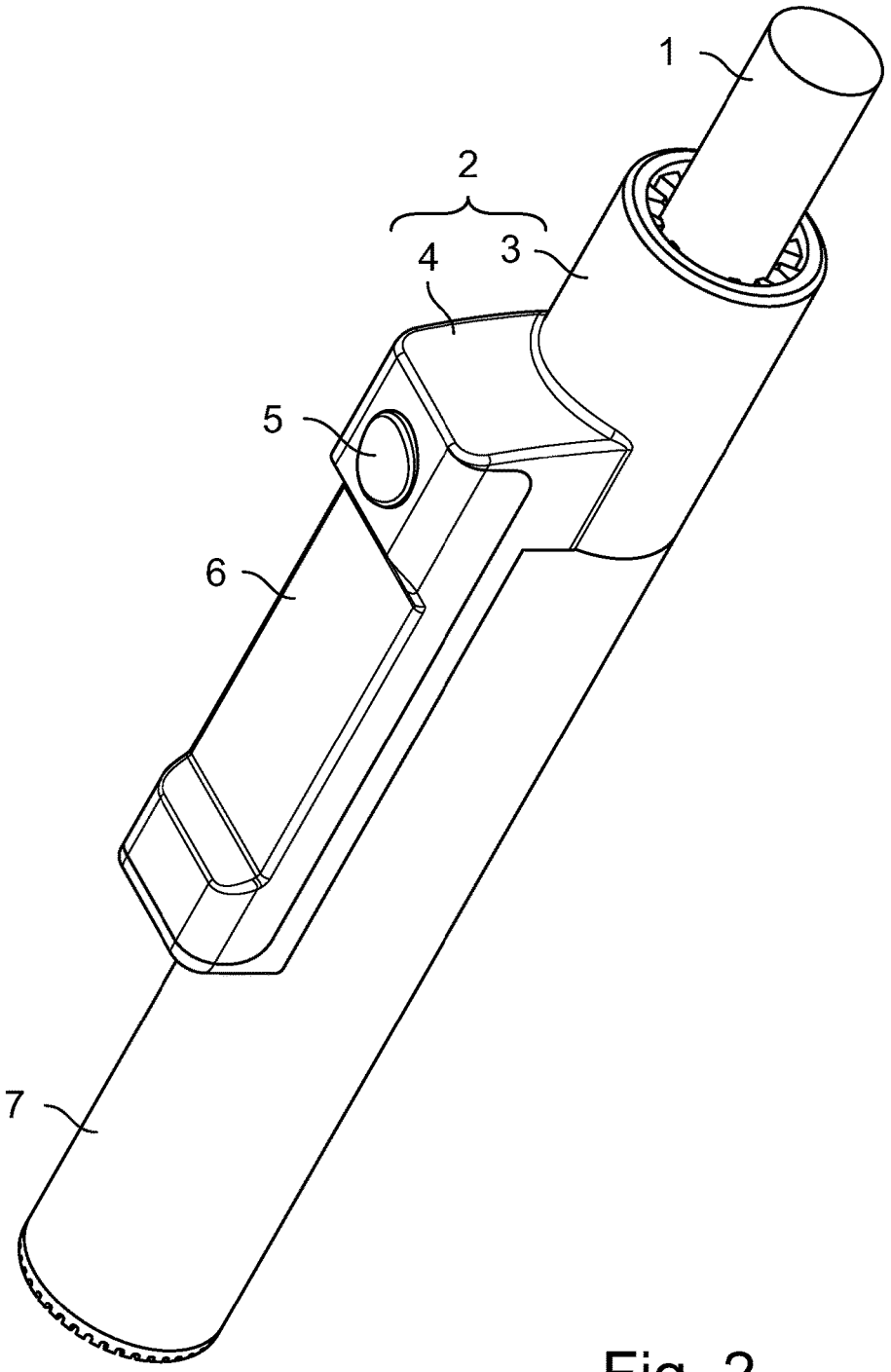
FIG. 2 a perspective view of the present invention showing components of the device.

As seen in FIGS. 1 and 2, the low-temperature heated non-combustion electronic cigarette includes a first holder 2, a second holder 6, an outer pipe 7, a cigarette cartridge 1, a control plate 9, a key 5, a buffer pad 8, an insulation retaining bracket 16, a heating, coil 13, a battery 17, two rivets 14 and two uprights 15. The first holder 2 includes a pipe 3 and a mounting plate 4. The mounting plate 4 is attached to the external wall of the pipe 3. The mounting plate 4 and the second holder 6 form an inner cavity. The control plate 9 is fixed in the inner cavity. The second holder 6 has a key 5. The key 5 is linked to the button on the control plate 9 with the buffer pad 8. The pipe 3 has a corrugated inner wall and place for insertion of a movable cigarette cartridge 1. The pipe 3 is connected with the outer pipe 7 and the opposite of the connection between the pipe 3 and the outer pipe 7 is the insertion end of the cigarette cartridge 1. The pipe 3 and the outer pipe 7 are internally connected. The outer pipe 7 has an insulation retaining bracket 16 and a battery 17. The insulation retaining bracket 16 is situated between the cigarette cartridge 1 and the battery 17. The insulation retaining bracket 16 has an installation slot 12 and the installation slot 12 faces the cigarette cartridge 1. The heating coil 13 is located at the installation slot 12. The heating coil 13 has two pins, and each of the two pins are fixed on an upright 15 with a rivet 14. The two uprights 15 are mounted on the insulation retaining bracket 16. The uprights 15 are connected to the control plate 9 with the welding electronic wires and the positive and negative electrodes of the battery 17 also connected to the control plate 9 with electronic wires.

The pipe 3 and the mounting plate 4 can be a one-piece structure or can be multiple piece assembly structures. The mounting plate 4 has a clipping strip while the second holder 6 has a slot matching with the clipping strip. The mounting plate 4 and the second holder 6 are connected with the clipping strip and the slot. The control plate 9 has a hole for the clipping strip to pass through. As an optimum embodiment, there should be two pieces of clipping strips and two slots.

The inner cavity and the internal portion of the pipe 3 is connected with the through hole between the pipe 3 and, the mounting plate 4. The electronic wires are connected to the control plate 9 by passing through the through hole 20. The distance between the through hole 20 and the connection between the pipe 3 and the outer pipe 7 is shorter than that between the through hole 20 and the opposite end of connection between the mounting plate 4 and the pipe 3. The mounting plate 4 has a USB connector 21 and the USB connector 21 can be a mini USB connector. The USB connector is exposed from the opposite end of the connection between the mounting plate 4 and the pipe 3. The USB connector 21 enables recharging of battery 17.

The length of the corrugation is shorter than that of the pipe 3 and the corrugation is situated between the through hole 20 and the insertion end of the cigarette cartridge 1. There is a protective ring 10 between the cigarette cartridge 1 and the pipe 3 while there is a gap between the protective rinse 10 and the cigarette cartridge 1 for air flow. The protective ring 10 is situated between the through hole 20 and the opposite of the insertion end of the cigarette cartridge 1. The protective ring 10 enhances the insulation effect, protects the electronic wires from the control plate 9 and prevents the wire skin of the electronic wires from being burned by the heating coil in operation. There is also a fixation ring 11 between the protective ring 10 and the pipe 3 for the purpose of effectively supporting the interference fit between the pipe 3 and the outer pipe 7 and preventing the pipe 3 from falling oft in case of deformation due to pressure of the outer pipe 7.

The opposite end of the connection between the outer pipe 7 and the pipe 3 has a lens 19, the outer pipe 7 has a lamp panel 18 and the lamp panel 18 is mounted between the battery 17 and the lens 19. The lamp panel 18 is mainly used as an indicator light. When the heating coil 13 is in operation, the Light Emitting Diode LED indicator lamp on the lamp panel 18 flashes to indicate the operating condition. The heating coil 13 is made of transfer heating element, such as alloy resistance wire or disc of transfer endothermic effect, which reduces the heating time of the cigarette cartridge and enables instant response by pressing the key without waiting, offering improved user experience.

Figure 3:
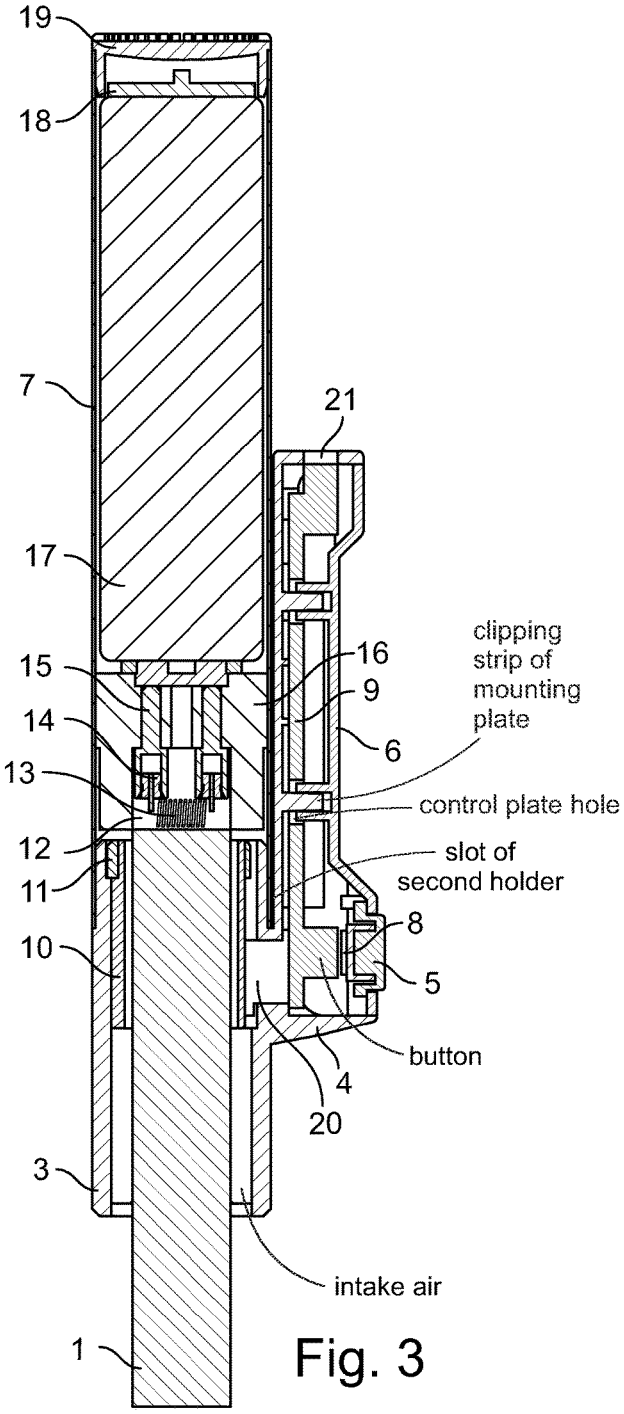
FIG. 3 is a cross-section view of the present invention.

Referring to FIG. 3, the arrow in FIG. 3 indicates the direction of air flow. In combination with FIGS. 1 and 2, the operation of the low-temperature heat-not-burn electronic cigarette is introduced as follows. The cigarette cartridge 1 is inserted from the insertion end of the pipe 3 and the corrugated structure of the inner wall of the pipe 3 can prevent the cigarette cartridge 1 from shaking or tilting. The heating coil 13 starts operating when the user presses the key 5 and the user can start smoking at the same time. When smoking, the air around the corrugation will be brought to the installation slot 12 on the insulation retaining bracket 16 and heated by the heating coil 13 to form hot air and then, the hot air will be brought into the cigarette cartridge 1, providing a fast track for air inflow and circulation and achieving effective insulation.

Figure 4:
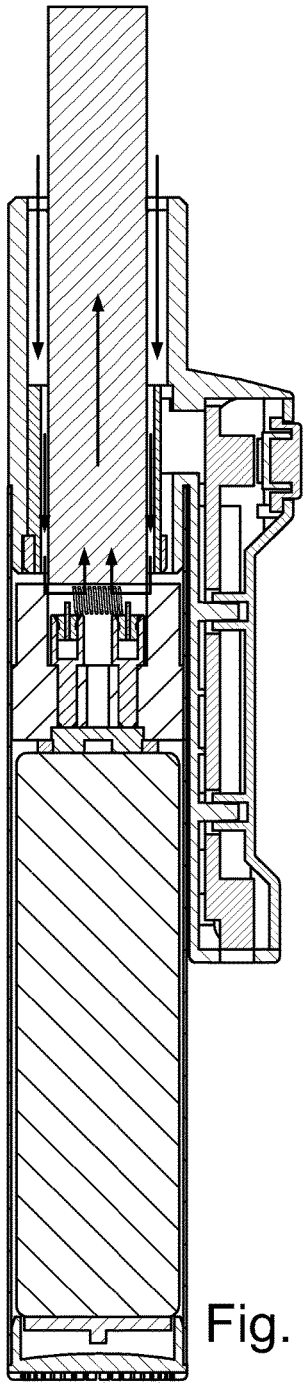
FIG. 4 is a cross-section schematic of thermal air currents in the electronic cigarette of the invention.
Figure 5:
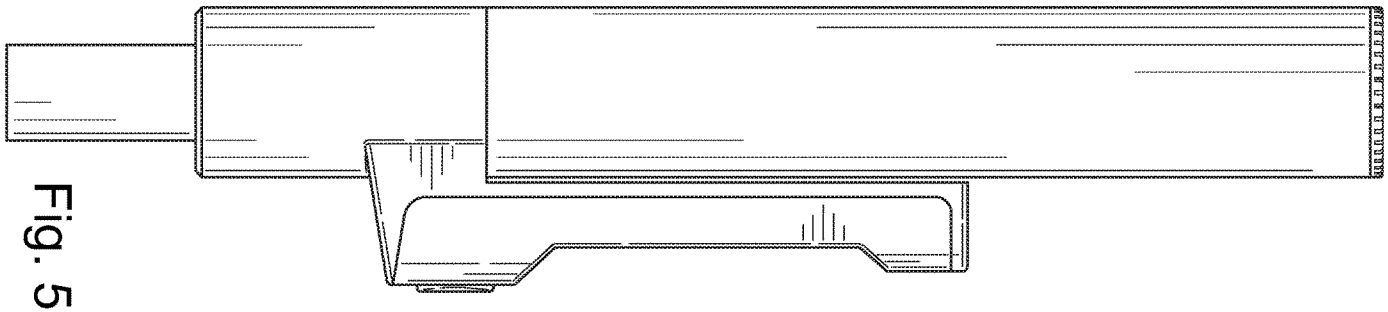
FIG. 5 is an external right side view of the present invention.

The cigarette cartridge 1 can be made in a variety of ways. As shown in FIG. 4, the low-temperature heat-not-burn cigarette 100 which can be a cartridge like a cigarette cartridge 1 which can have: a filtration rod 110; a tobacco column 120; and a heat-resistant paper 130. One end of the filtration rod 110 is attached to one end of the tobacco column 120 and the filtration rod 110 and tobacco column 120 are wrapped by the heat-resistant paper 130. The cylindrical filtration rod 110 is made of filtration materials. The filtration rod 110 is a single-filter rod made from acrylic fiber. Tobacco column 120 has the honeycomb structure with the size and quantity of holes 121 on the tobacco column 120 to be determined based on the required permeability. In this embodiment, as shown in FIG. 5, tobacco column is a honeycomb cylinder. The tobacco column 120 has twelve holes 121 and these 12 holes are evenly distributed. The heat-resistant paper 130 is made from heat-resistant materials. The heat-resistant paper 130 is a piece of polypropylene paper.

The components of the tobacco column 120 include 70% plant powder, 20% tobacco concrete and 10% flavors and fragrances in terms of mass fraction. In this embodiment, the plant powder comprising of 70% of the tobacco column 120 is made of at least one of the roots, stems, leaves, blossoms or fruits of plants by drying and grinding.

Preparation Method:

(1) Grind and thoroughly mix the components including 70% plant powder, 20% tobacco concrete and 10% flavors and fragrances and then compress them into a honeycomb tobacco column with sheeter and honeycomb die. The density of tobacco column is controlled and determined by the pressure during compression while the honeycomb structure of the tobacco column is made with the honeycomb die.

(2) Connect the compressed honeycomb tobacco column to one end of the filtration rod and wrap the tobacco column and filtration rod with the heat-resistant paper.

Figure 13:
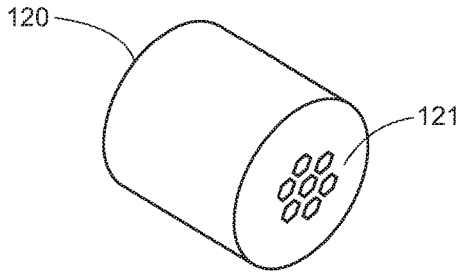
FIG. 13 is another schematic of the tobacco column in the embodiment of the invention.

Another construction for the low-temperature heat-not-burn cigarette 100 is when the filtration rod 110 is a double-filter rod made from cellulose acetate and active carbon. Tobacco column 120 can have a honeycomb structure with the size and quantity of holes 121 on the tobacco column 120 to be determined based on the required permeability. As shown in FIG. 13, the tobacco column 120 can be a honeycomb cylinder. The tobacco column 120 has ten holes 121 and these ten holes are evenly distributed. The heat-resistant paper 130 is made from heat-resistant materials. The heat-resistant paper 130 can be a piece of ceramic fiber paper. The components of the tobacco column 120 can include 90% tobacco powder, 5% tobacco essence and solanesol, 4% flavors and fragrances and 1% tobacco glue, preservative and fire retardant in terms of mass fraction. The tobacco powder preferably comprises 90% of the tobacco column 120 made of at least one of the roots, stems and leaves of cigars by drying and grinding.

Preparation Method:

(1) Grind and thoroughly mix the components including 90% tobacco powder, 5% tobacco essence and solanesol, 4% flavors and fragrances and 1% tobacco glue and fire retardant and compress them into a honeycomb tobacco, column with sheeter and honeycomb die. The density of tobacco column is controlled and determined by the pressure during compression while the honeycomb structure of the tobacco column is made with the honeycomb die.

(2) Connect the compressed honeycomb tobacco column to one end of the filtration rod and wrap the tobacco column and filtration rod with the heat-resistant paper.

Another construction for the the low-temperature heat-not-burn cigarette 100 is when the filtration rod 110 is a single-filter rod made from cellulose acetate. The tobacco column 120 has a honeycomb structure with the size and quantity of holes 121 on the tobacco column 120 to be determined based on the required permeability. As shown in FIG. 13, the tobacco column 120 is a honeycomb cylinder. The tobacco column 120 has ten holes 121 and these ten holes are evenly distributed. Heat-resistant paper 130 is made from heat-resistant material. Here, the heat-resistant paper 130 is a piece of teflon paper.

The components of the tobacco column 120 include 80% tobacco, powder, 14% tobacco concrete, nicotine and solanesol, 5.5% flavors and fragrances and 0.5% tobacco glue in terms of mass fraction. In this formulation, the tobacco powder comprising 80% of the tobacco column 120 is made of at least one of the roots, stems and leaves of three types of tobacco including flue-cured tobacco, burley tobacco, aromatic tobacco by drying and grinding.

Preparation Method:

(1) Grind and thoroughly mix the components including 80% tobacco powder, 14% tobacco concrete, nicotine and solanesol, 5.5% flavors and fragrances and 0.5% tobacco glue and compress them into a honeycomb tobacco column with sheeter and honeycomb die. The density of tobacco column is controlled and determined by the pressure during compression while the honeycomb structure of the tobacco column is made with the honeycomb die.

(2) Connect the compressed honeycomb tobacco column to one end, of the filtration rod and wrap the tobacco column and filtration rod with the heat-resistant paper.

Figure 6:
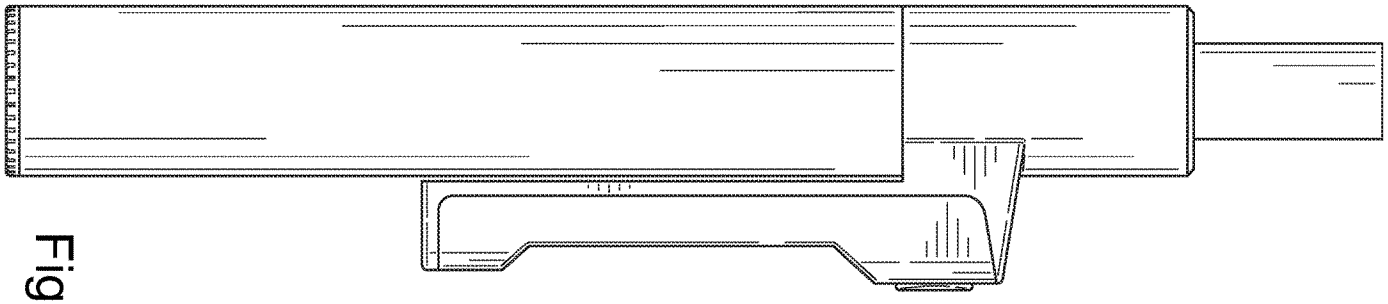
FIG. 6 is an external left side view of the present invention.
Figure 7:
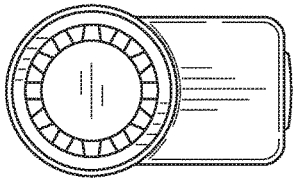
FIG. 7 is an external top view of the present invention.
Figure 8:
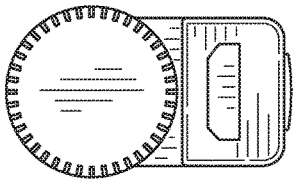
FIG. 8 is an external bottom view of the present invention.
Figure 9:
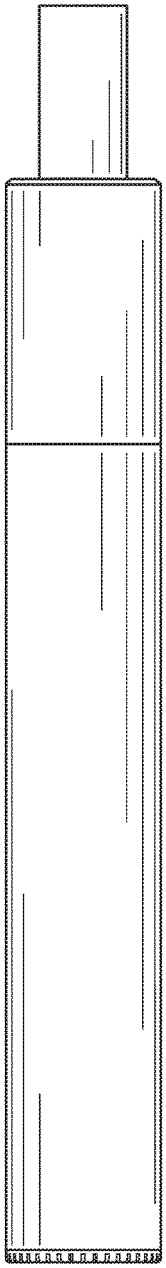
FIG. 9 is an external front view of the present invention.
Figure 10:
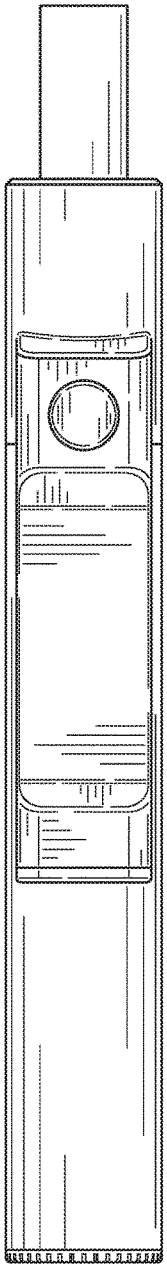
FIG. 10 is an external front view of the present invention.
Figure 11:
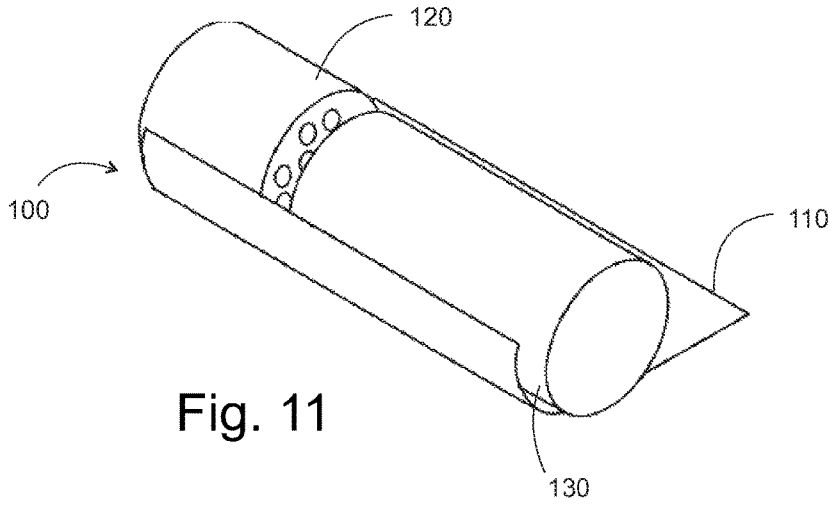
FIG. 11 is the schematic of the low-temperature heat-not-burn cigarette in the embodiment of the invention.
Figure 12:
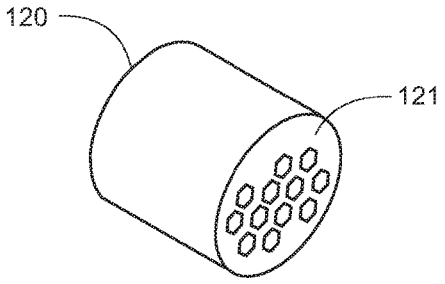
FIG. 12 is the schematic of the tobacco column in the embodiment of the invention.

Optionally, the filtration rod 110 is a multiple-filter rod made from cellulose acetate, acrylic fiber, crumpling paper and active carbon. The tobacco column 120 has a honeycomb structure with the size and quantity of holes 121 on the tobacco column 120 to be determined based on the required permeability. In this embodiment, as shown in FIG. 6, the tobacco column 120 can be a honeycomb cylinder. The tobacco column 120 has ten holes 121 and these then holes are evenly distributed. The heat-resistant paper 130 is made from heat-resistant materials and in this embodiment, the heat-resistant paper 130 is a piece of aluminum foil.

The components of the tobacco column 120 include 70% tobacco powder and plant powder, 20% nicotine and solanesol, 9.9% flavors and fragrances and 0.1% preservative in terms of mass fraction. In this embodiment, the tobacco powder is made of the roots, stems and leaves of at least one of four types of tobacco including flue-cured tobacco, burley tobacco, aromatic tobacco or cigar by drying and grinding while the plant powder is made of at least one of the roots, stems, leaves, blossoms and fruits of plants by drying and grinding.

Preparation Method:

(1) Grind and thoroughly mix the components including 70% tobacco powder and plant powder, 20% nicotine and solanesol, 9.9% flavors, and fragrances and 0.1% preservative and compress them into a honeycomb tobacco column with sheeter and honeycomb die. The density of tobacco column is controlled and determined by the pressure during compression while the honeycomb structure of the tobacco column is made with the honeycomb die.

(2) Connect the compressed honeycomb tobacco column to one end of the filtration rod and wrap the tobacco column and filtration rod with the heat-resistant paper.

The honeycomb tobacco column not only meets the demand for density and permeability, but also can be arranged in any geometric or artistic patterns besides the round cylindrical shape. The heat-resistant paper of the invention can be made of the materials in the specific embodiments as well as other heat-resistant materials such as cellophane and polyethylene terephthalate. Additives are used for making adjustment to heating efficiency or achieve a specific effect or certain molding requirements, not limited to those mentioned in the specific embodiments. For example, the additives can contain combustion-supporting agent. Yet, if the additives contain combustion-supporting agent, no fire retardant should be added.

SUMMARY OF THE DETAILED DESCRIPTION

A low-temperature heat-not-burn electronic cigarette has a first holder 2, and the first holder 2 includes a pipe 3 and a mounting plate 4. The mounting plate is attached to the external wall of the pipe 3. The cigarette also has a second holder 6, and the mounting plate 4 and the second holder 6 form an inner cavity. An outer pipe 7 encloses a battery 17, and the outer pipe 7 forms a housing. A cigarette cartridge 1 has: a filtration rod 110, a honeycomb tobacco column 120 and a heat-resistant paper 130. An end of the filtration rod 110 is attached to the tobacco column 120. The filtration rod 110 and the tobacco column 120 are wrapped in heat-resistant paper 130.

The cigarette has a control plate 9 is fixed on the inner cavity and a key 5. The second holder 6 links the key 5 to a button on the control plate 9 with the buffer pad 8. An insulation retaining bracket 16 retains a heating coil 13. The insulation retaining bracket 16 retains a heating coil 13 using a rivet 14 mounted to an upright 15. The heating coil 13 is mounted to the rivet 14. Intake air passes along an external surface of the cigarette cartridge 1 before being heated by the heating coil 13.

The pipe 3 has a corrugated internal wall that engages the cigarette cartridge 1 inserted into the pipe 3. The cigarette cartridge 1 is removable from the corrugated internal wall. The pipe 3 is connected to the outer pipe 7 and an end of the pipe 3 opposite to that connected to the outer pipe 7 is used as the insertion end of the cigarette cartridge 1. The pipe 3 is connected to an internal surface of the outer pipe 7, and the outer pipe 7 has an insulation retaining bracket 16 and battery 17 in it with an insulation retaining bracket 16 mounted between the cigarette cartridge 1 and the battery 17.

The insulation retaining bracket 16 has an installation slot 12. The installation slot 12 faces the cigarette cartridge 1, and the heating coil 13 is installed in the installation slot 12. The heating coil 13 has two pins fixed on the upright 15 with the rivet 14, and the upright 15 is mounted on the insulation retaining bracket 16. The two uprights 15 are electrically connected to the control plate 9 and the positive and negative electrodes of the battery 17 also are electrically connected to the control plate 9.

Mixed powder is compressed into the tobacco column 120 and the mixed powder has: 70-90% tobacco or plant powder or both, 5-20% tobacco extract and 4-10% mixed powder of flavors and fragrances by mass fraction.

The pipe 3 and the mounting plate 4 are connected with the through hole 20 in the inner cavity and the pipe 3. The distance between a through hole 20 and the connection between the pipe 3 and the outer pipe 7 is shorter than that between the through hole 20 and the opposite end of connection between the mounting plate 4 and the pipe 3. The mounting plate 4 has a USB connector 21, and the USB connector 21 is exposed at the opposite end of a connection between the mounting plate 4 and the pipe 3.

The pipe 3 has a corrugated internal wall. A length of the corrugated internal wall is shorter than a length of the pipe 3. The corrugation is situated between the through hole 20 and the insertion end of the cigarette cartridge 1. A protective ring 10 fits between the cigarette cartridge 1 and the pipe 3. The protective ring 10 is installed between the through hole 20, which is opposite to the insertion end of the cigarette cartridge 1. The lamp panel 18 is mounted between the battery 17 and the lens 19. The mounting plate 4 has a clipping strip and the second holder 6 has a slot matching with the clipping strips. The mounting plate 4 is connected to the second holder 6 with the dipping strip connected to the slot and the control plate 9 having a hole for the clipping strip to pass through.

The tobacco extract contains one or more of tobacco concrete, essence, nicotine and solanesol, and the heat-resistant paper is made of PP, PET, cellophane, ceramic fiber paper, teflon paper or aluminum foil. The tobacco powder contains one or more of flue-cured tobacco, burley tobacco, cigar or aromatic tobacco. The mixed powder also contains 0.1-1% additives in terms of mass fraction. The mixed powder also contains 0.1-1% additives in terms of mass fraction. The cigarette cartridge is made by the steps of: preparing the honeycomb tobacco column by mixing and grinding the mixed powder and then compressing it into a honeycomb tobacco column; and connecting the compressed honeycomb tobacco column to one end of the filtration rod and then wrapping the tobacco column and filtration rod with the heat-resistant paper.

The invention claimed is:

1. A low-temperature heat-not-burn electronic cigarette comprising:

a first holder (2), wherein the first holder (2) includes a pipe (3) and a mounting plate (4), wherein the mounting plate is attached to an external wall of the pipe (3);

a second holder (6), wherein the mounting plate (4) and the second holder (6) form an inner cavity;

an outer pipe (7) enclosing a battery (17), wherein the outer pipe (7), forms a housing that retains the battery (17);

a cigarette cartridge (1) including: a filtration rod (110), a honeycomb tobacco column (120) and a heat-resistant paper (130); wherein an end of the filtration rod (110) is attached to the tobacco column (120) and the filtration rod (110) and the honeycomb tobacco column (120) are wrapped in the heat-resistant paper (130);

a control plate (9), wherein the control plate (9) is fixed on the inner cavity;

a key (5) on the second holder (6), wherein the second holder (6) links the operation of the key (5) to a button on the control plate (9) with a buffer pad (8) by aligning the key (5) to the button on the control plate (9) with the buffer pad (8); and an insulation retaining bracket (16) retaining a heating coil (13), wherein the insulation retaining bracket (16) is mounted between the pipe (3) and the battery (17), wherein the housing retains the insulation retaining bracket (16) and heating coil (13).

2. The low-temperature heat-not-burn electronic cigarette of claim 1, wherein the insulation retaining bracket (16) retains the heating coil (13) using a rivet (14) mounted to an upright (15), wherein the heating coil (13) is mounted to the rivet (14).

3. The low-temperature heat-not-burn electronic cigarette of claim 2, wherein the heating coil (13) further includes two pins fixed on the upright (15) with the rivet (14), wherein the upright (15) is mounted on the insulation retaining bracket (16), wherein the upright (15) is electrically connected to the control plate (9) and the positive and negative electrodes of the battery (17) also are electrically connected to the control plate (9).

4. The low-temperature heat-not-burn electronic cigarette of claim 1, wherein the pipe (3) has a corrugated internal wall that engages the cigarette cartridge (1) inserted into the pipe (3), wherein the cigarette cartridge (1) is removable from the corrugated internal wall.

5. The low-temperature heat-not-burn electronic cigarette of claim 4, wherein the pipe (3) is connected to the outer pipe (7) and an end of the pipe (3) opposite to that connected to the outer pipe (7) is used as an insertion end of the cigarette cartridge (1) wherein, the pipe (3) is connected to an internal surface of the outer pipe (7), and wherein the outer pipe (7) has an insulation retaining bracket (16) and the battery (17), wherein an insulation retaining bracket (16) is mounted between the cigarette cartridge (1) and the battery (17).

6. The low-temperature heat-not-burn electronic cigarette of claim 5, wherein the insulation retaining bracket (16) has an installation slot (12), wherein the installation slot (12) faces the cigarette cartridge (1), and wherein the heating coil (13) installed in the installation slot (12).

7. The low-temperature heat-not-burn electronic cigarette of claim 1, a mixed powder is compressed into the tobacco column (120) and the mixed powder has: 70-90% tobacco or plant powder or both, 5-20% tobacco extract and 4-10% mixed powder of flavors and fragrances by mass fraction.

8. The low-temperature heat-not-burn electronic cigarette of claim 1, wherein the pipe (3) and the mounting plate (4) are connected with a through hole (20), which is formed upon both the inner cavity and the pipe (3).

9. The low-temperature heat-not-burn electronic cigarette of claim 8, wherein the distance between the through hole (20) and the connection between the pipe (3) and the outer pipe (7) is shorter than that between the through hole (20) and the opposite end of connection between the mounting plate (4) and the pipe (3).

10. The low-temperature heat-not-burn electronic cigarette of claim 9, wherein the mounting plate (4) has a USB connector (21), the USB connector (21) exposed at the opposite end of a connection between the mounting plate (4) and the pipe (3).

11. The low-temperature heat-not-burn electronic cigarette of claim 9, wherein the pipe (3) has a corrugated internal wall, wherein a length of the corrugated internal wall is shorter than a length of the pipe (3), wherein the corrugation is situated between the through hole (20) and an insertion end of the cigarette cartridge (1).

12. The low-temperature heat-not-burn electronic cigarette of claim 9, further including a protective ring (10) between the cigarette cartridge (1) and the pipe (3) wherein the protective ring (10) is installed between the through hole (20), which is opposite to an insertion end of the cigarette cartridge (1).

* * * * *